US010912979B1

(12) United States Patent
Gathright et al.

(10) Patent No.: US 10,912,979 B1
(45) Date of Patent: Feb. 9, 2021

(54) GOLF SWING TRAINING AID

(71) Applicant: HD Golf Performance, LLC, San Antonio, TX (US)

(72) Inventors: Hunter Braden Gathright, San Antonio, TX (US); Ivor Derek Loebbecke, San Antonio, TX (US)

( * ) Notice: Subject to any disclaimer, the term of this patent is extended or adjusted under 35 U.S.C. 154(b) by 0 days.

(21) Appl. No.: 16/872,262

(22) Filed: May 11, 2020

Related U.S. Application Data

(60) Provisional application No. 62/845,458, filed on May 9, 2019.

(51) Int. Cl.
*A63B 69/36* (2006.01)

(52) U.S. Cl.
CPC ..... *A63B 69/3632* (2013.01)

(58) Field of Classification Search
CPC . A63B 69/3632; A63B 15/00; A63B 69/0002; A63B 69/3623; A63B 69/38; A63B 2069/0008; A63B 21/0552; A63B 21/0442; A63B 69/00; A63B 21/4035; A63B 69/0088; A63B 69/36212; A63B 21/0555; A63B 21/018; A63B 21/151
USPC ..... 473/201, 206, 219, 231, 232, 234, 256, 473/298, 299
See application file for complete search history.

(56) References Cited

U.S. PATENT DOCUMENTS 1,930,342 A * 10/1933 Graham ..... A63B 69/3632 473/232
3,229,980 A * 1/1966 Silberman ..... A63B 69/3632 473/232
3,428,325 A * 2/1969 Atkinson ..... A63B 15/00 473/256
3,743,297 A * 7/1973 Dennis ..... A63B 15/00 473/242
4,602,788 A * 7/1986 Wendt ..... A63B 15/00 473/242
5,249,803 A * 10/1993 Giffin ..... A63B 15/00 473/256
5,807,183 A * 9/1998 Benson ..... A63B 15/005 473/206
5,947,835 A * 9/1999 Fenton, Jr. ..... A63B 21/0552 473/229
6,910,973 B2 * 6/2005 Kuster ..... A63B 69/36212 473/219

* cited by examiner

*Primary Examiner* — Nini F Legesse
(74) *Attorney, Agent, or Firm* — Phillip Free Law, PLLC

(57) ABSTRACT

This invention relates to a golf swing training aid useful for training swing speed and swing efficiency. The inventive swing training aid includes a golf club shaft that has open proximal and distal ends and a grip. The interior of the shaft is a hollow chamber and the diameter decreases gradually from the proximal end to the distal end. A cable is captured within the hollow chamber and extends from the distal end of the shaft, terminating in an integrally formed attachment loop. A weighted ball is removably linked to the attachment loop by a connector.

18 Claims, 6 Drawing Sheets

GOLF SWING TRAINING AID

CROSS REFERENCE TO RELATED APPLICATIONS

This application claims the benefit of U.S. provisional application No. 62/845,458 entitled "Golf Swing Training Aid," filed May 9, 2020, the contents of which are incorporated herein by reference.

FIELD OF THE INVENTION

The present invention relates to the field of golf training aids and more particularly, but not by way of limitation, to the field of golf training aids for improving swing speed and swing efficiency.

DETAILED DESCRIPTION OF THE PREFERRED EMBODIMENTS

Figure 1:
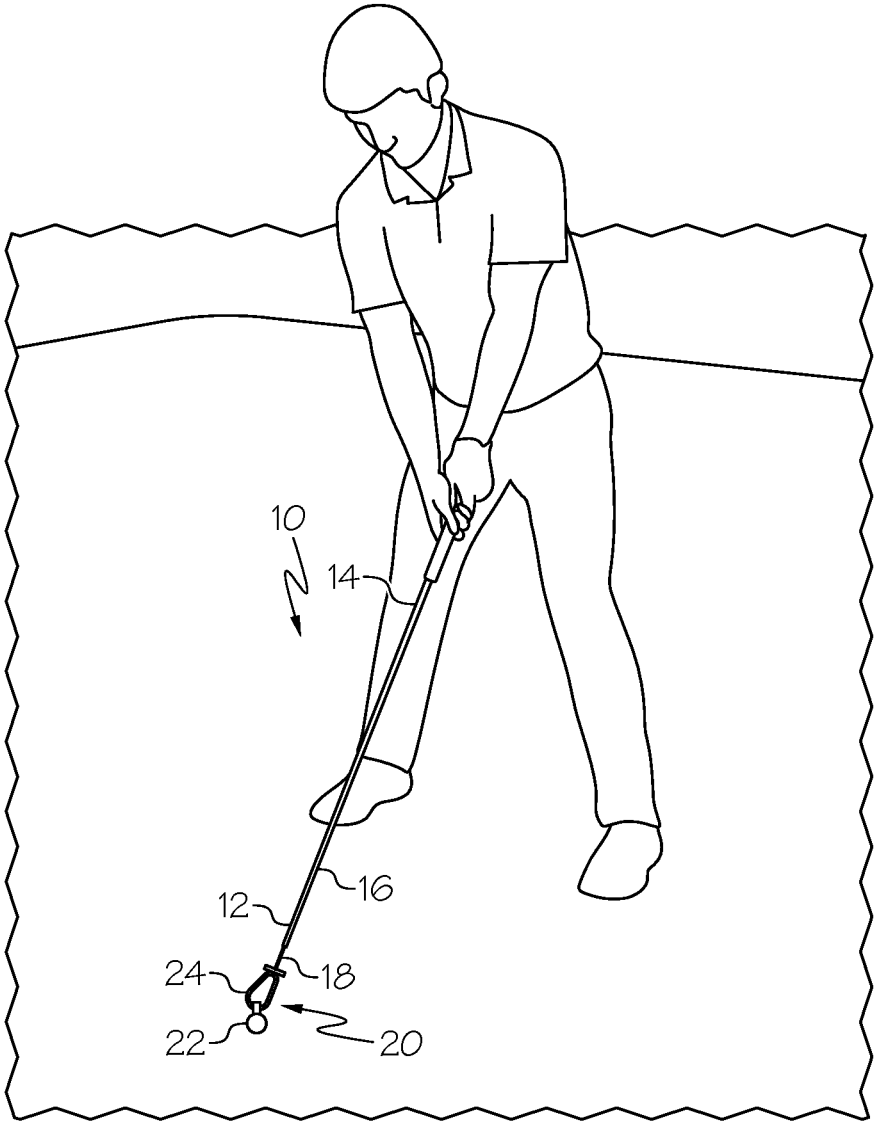
FIG. 1 is a perspective view of a golfer using the swing training aid of the present invention.

Referring to FIG. 1, the present invention is a golf swing training aid useful for training swing speed and swing efficiency. In a preferred embodiment, the inventive swing training aid 10 includes golf club shaft 12 that has open proximal and distal ends, 14 and 16, respectively and a grip 17. As with most golf club shafts, the interior of the shaft 12 is a hollow chamber and the diameter decreases gradually from the proximal end 14 to the distal end 16. A cable 18 is captured within the hollow chamber and extends from the distal end 16 of the shaft 12, terminating in an integrally formed attachment loop 20. A weighted ball 22 is removably linked to the attachment loop by a connector 24, as shown.

Figure 2:
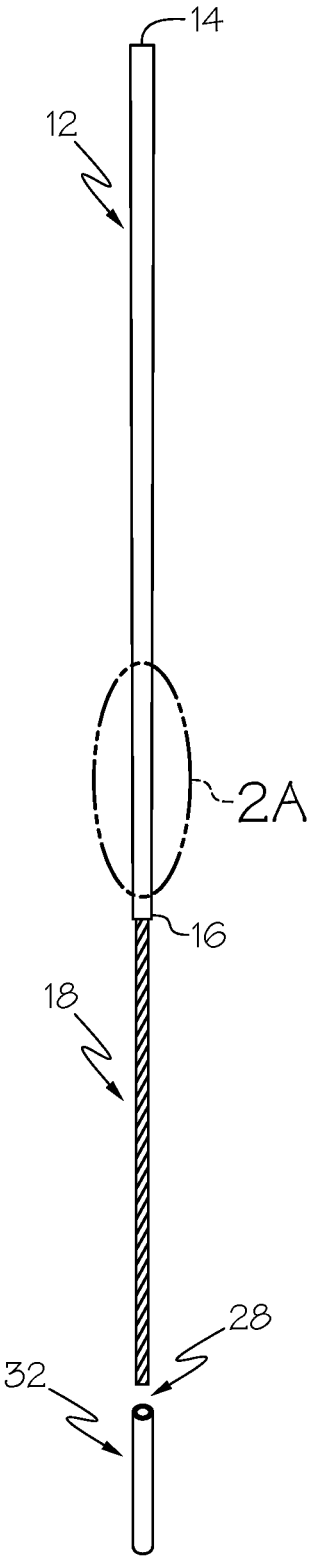
FIG. 2 is a partially exploded view of the club shaft, cable and sleeve of the preferred embodiment.
Figure 2A:
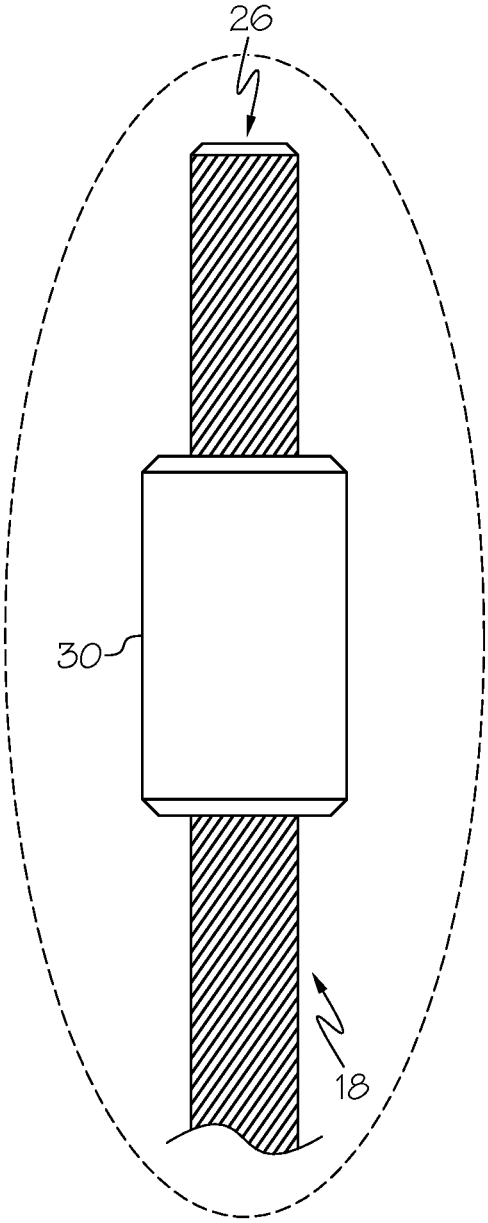
FIG. 2A is a detail view of the button stop installed on the cable.

Referring now to FIGS. 2 and 2A, in a preferred embodiment, the cable 18 has a first end 26 and a second end 28. In the presently described embodiment, the cable 18 is a length of steel cable. However, persons skilled in the art will recognize that the cable 18 can be constructed from any other suitable material that provides both flexibility and stiffness suitable for the purpose of the present invention similar to steel cable. As used herein, the term "cable" is intended to cover all such suitable material. A button stop 30 or other similar device is slipped onto the cable 18 and is attached near the first end 26 of the cable 18 by means of a weld, adhesive or other well-known way of rigidly attaching the button stop 30 to the cable 18. The button stop 30 is sized such that it is smaller in diameter than the maximum diameter and larger than the minimum diameter of the club shaft 12. The second end 28 of the cable 18 is threaded into the open proximal end 14 of the club shaft 12 such that the button stop 30 attached to the first end 26 of the cable 18 is captured within the club shaft 12, as indicated on FIG. 2. A grip 17 is installed on the proximal end 14 of the club shaft 12.

Figure 3:
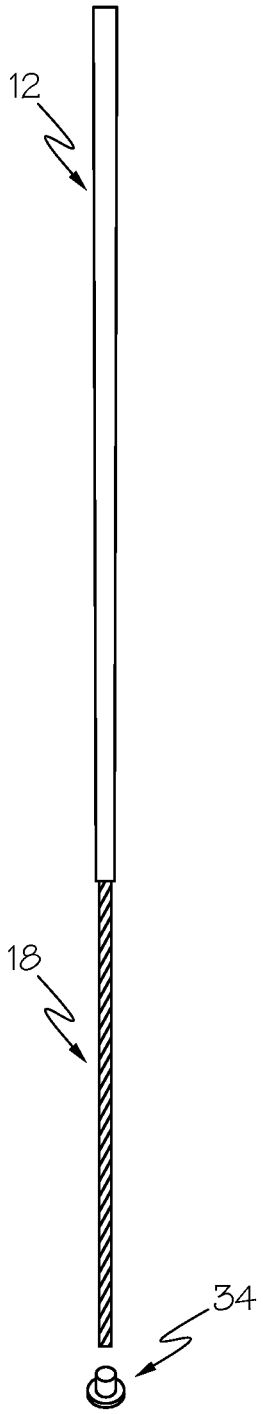
FIG. 3 is partially exploded view of an alternative embodiment of the club shaft and cable with a grommet.

The second end 28 of the cable 18 extends from the open distal end 16 of the club shaft 12. Preferably, a sleeve 32 is slid over the second end 28 of the cable 18 and is used to fill the space between the cable 18 and the club shaft 12. In highly preferred embodiments, the sleeve 32 is a one-inch polyethylene sleeve that is epoxied into place within the distal end 16 and protrudes about one-eighth of an inch beyond the open distal end 16 of the club shaft 12. In an alternative embodiment shown in FIG. 3, the sleeve 32 can be replaced with a rubber grommet 34 which is threaded onto the second end 28 of the cable 18 until it matingly engages the distal end 16 of the club shaft 12, forming a cap. The grommet 34 is glued into place using epoxy glue, which should be allowed to fully dry.

Figure 4:
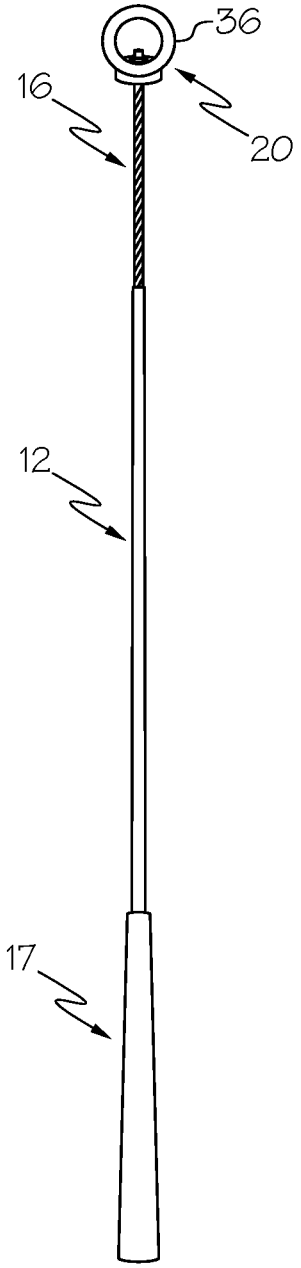
FIG. 4 is a perspective view of a preferred embodiment of the present invention.
Figure 8:
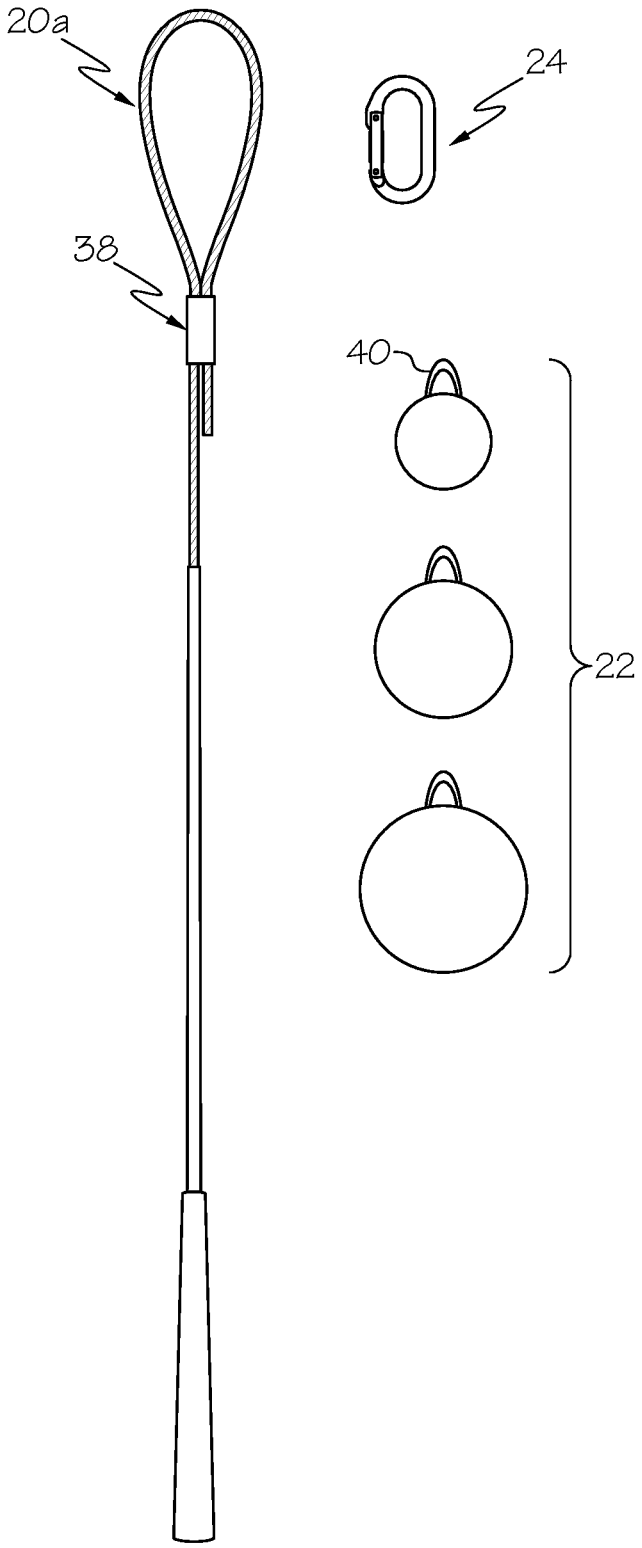
FIG. 8 is perspective view of an alternative embodiment of the golf training aid of the present invention.

Turning now to FIG. 4, the attachment loop 20 is integrally formed at the second end 28 of the cable 18. In the preferred embodiment, the attachment loop 20 is formed by passing the cable 18 through the threaded hole in an eye nut 36 and braising the cable 18 to the eye nut 36. Additional braise can be applied to the second end 28 of the cable 18 to prevent fraying of the wire. Alternatively, as shown in FIG. 8, the second end of the cable can be formed into an attachment loop 20*a* by use of a crimp 38 which is preferably attached via weld. Persons skilled in the art will recognize other means of integrally forming an attachment loop 20 on the second end 28 of the cable 18, all of which are encompassed within the scope of the present invention.

Figure 5:
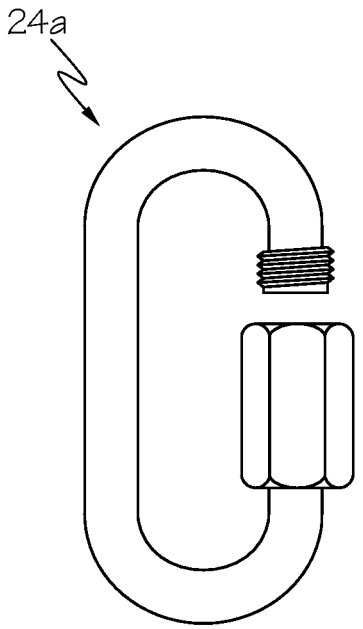
FIG. 5 is a perspective view of one embodiment of connector.
Figure 6:
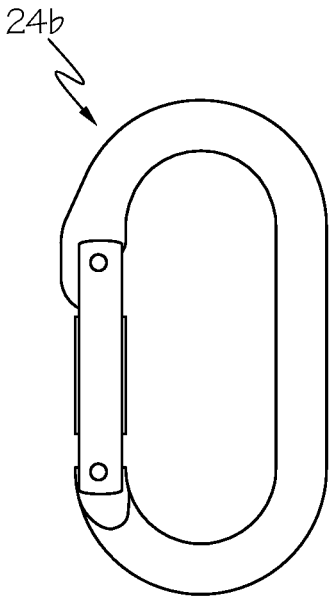
FIG. 6 is a perspective view of one embodiment of connector.
Figure 7:
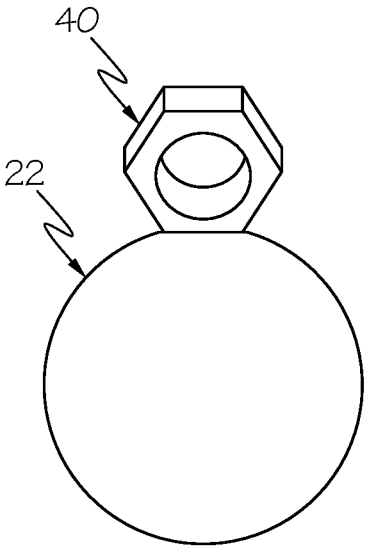
FIG. 7 is a perspective view of the weighted ball.

As shown in FIGS. 5-7, the present invention also includes a connector 24 that is used to removably link a weighted ball 22 having an integral eyelet 40 to the attachment loop 20. In preferred embodiments, the connector 24 can be a either a threaded, locking quick link 24*a* or a gated carabiner 24*b*. There are numerous other suitable structures for the connector 24, all of which are encompassed within the spirit of the present invention, as long as the structures provide a means of conveniently providing a removable link between the attachment loop 20 and the weighted ball 22.

The weighted ball 22 and integral eyelet 40 can be formed by grinding a flat surface on a steel ball bearing. A hexagonal nut can then be welded to the flat surface of the weighted ball 22 to form the integral eyelet 40. Alternatively, the weighted ball 22 and eyelet 40 can be formed together during the casting process. As shown in FIG. 8, the swing training aid 10 will preferably be provided with a set of three weighted balls 22. The weighted balls 22 are designed such that at least one of the weighted balls 22 will make the swing training aid 10 lighter than a normal club and at least one of the weighted balls 22 will make it heavier than a normal club. In the presently preferred embodiment, the weight of the three balls is selected such that the total weight of the swing training aid 10, after accounting for all the various components described above, is 5-10% lighter, 15-20% lighter, and 5-10% heavier than the typical driver weight. Two particularly preferred sets of weighted balls 22, one for a lighter club and one for a heavier club, are summarized in the Table 1 below.

TABLE 1

| Light Set | | Heavy Set | |
|---|---|---|---|
| Ball | Weight | Ball | Weight |
| Heavy | 115 g | Heavy | 150 g |
| Medium | 70 g | Medium | 100 g |
| Light | 50 g | Light | 70 g |

Increasing the load allows the brain to train the correct motor patterns at varying weights/speeds with the ultimate goal being a combination of increased speed and efficiency.

Operation

Figure 9:
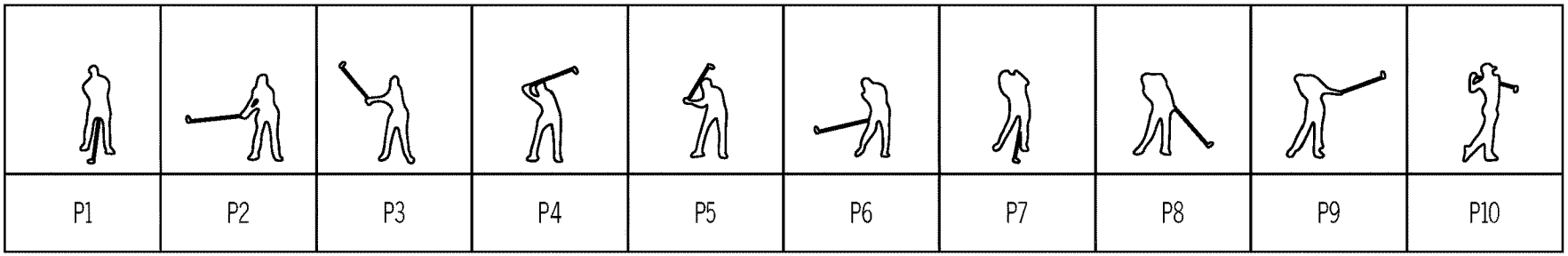
FIG. 9 is a table showing the ten basic golf swing positions.

It has widely been accepted the golf swing can be broken into 10 basic positions based upon set-up and club/arm position, as shown in FIG. 9. See Mac O'Grady's 10 Positions of the Golf Swing.

TABLE 2

| Backswing | | Downswing | |
|---|---|---|---|
| P1 | Set-Up Position | P5 | Lead Arm parallel to ground |
| P2 | Club parallel to ground | P6 | Club Shaft parallel to ground |
| P3 | Lead Arm parallel to ground | P7 | Impact |
| P4 | Top of Backswing | P8 | Club Shaft parallel to ground |
| | | P9 | Trail arm parallel to ground |
| | | P10 | Finish position |

Takeaway (P1-P2)

The swing training aid 10 of the present invention is meant to be taken back low and slow; this is to create width and keep the connection of the arms and body feeling "together." If taken back incorrectly, the weighted ball 22 will be left behind, and the shaft leads the weighted ball 22 and connector 24 on the way back (whipping motion). This will be felt within the first few inches of the takeaway and can be seen when the weighted ball 22 does not hinge/fall down towards the ground. Once the handle/hands/shaft are leading the ball on the backswing (as opposed to a "one-piece takeaway") the transition to P3-P4 and beyond is extremely difficult for amateur golfers to re-route or fix.

Top of the Swing/Transition (P3-P4)

The pause at the top of the swing is key. This "setting" of the club at top of the backswing will establish the completion of the load into the transition of the downswing. The present invention with dual breaking points allows the golfer to feel the shallowing of the club without the sensation of "Casting" while helping to maintain the angle/load of the wrist, or "lag" as you accelerate to impact. "Early Extension" and "Casting" are "Power Leak" moves that attempt to apply power at incorrect times in the Kinematic Sequence. When incorrect power is applied with the swing training aid of the present invention at P3-P4, the golfer will feel a sensation of throwing lures with a fishing rod, throwing a lacrosse ball, etc. (a slingshot effect applying power to the incorrect swing arc).

Impact/Follow-Through/Finish (P5-P10)

"Speed thru Impact" is a phrase coined to describe the proper application of power in the golf swing. Because the present swing training aid addresses and corrects common swing flaws found in P1-P4, the proper application of overspeed training can be utilized. Overspeed training is the theory of taking a known motor pattern and getting the body to move at a faster-than-normal speed.

It will be understood by persons skilled in the art that even though numerous characteristics and advantages of various embodiments of the present disclosure have been set forth in the foregoing description, together with details of the structure and function of various embodiments, this detailed description is illustrative only, and changes may be made in detail, especially in matters of structure and arrangements of parts within the principles of the present invention.

The invention claimed is:

1. A golf training device comprising:

a shaft having hollow chamber, a proximal end and a distal end, wherein the diameter of the proximal end of the shaft is larger than the diameter of the distal end of the shaft;

a cable disposed within the hollow chamber of the shaft and having a first end and a second end, wherein the first end of the cable is captured within the chamber of the shaft and the second end of the cable extends from the distal end of the shaft and has an integral attachment loop;

a first weighted ball having an integral eyelet;

a connector removably linking the attachment loop on the second end of the cable to the eyelet of the weighted ball; and a grip mounted on the proximal end of the shaft.

2. The golf training device of claim 1 wherein a stop is attached to the cable near the first end thereof and is used to capture the first end of the cable within the hollow chamber of the shaft.

3. The golf training device of claim 2 wherein the stop is a button stop.

4. The golf training device of claim 1 wherein the attachment loop is an eye nut integrally attached to the second end of the cable.

5. The golf training device of claim 1 wherein the attachment loop is formed using the second end of the cable and a crimp to fashion a loop.

6. The golf training device of claim 1 wherein the connector is a quick link.

7. The golf training device of claim 1 wherein the connector is a carabiner.

8. The golf training device of claim 1 further comprising a second weighted ball having an integral eyelet that can be interchanged with the first weighted ball by means of the connector, wherein the weights of the first and second weighted balls are different.

9. A golf training device comprising:

a shaft having hollow chamber, a proximal end and a distal end, wherein the diameter of the proximal end of the shaft is larger than the diameter of the distal end of the shaft;

a cable disposed within the hollow chamber of the shaft and having a first end and a second end, and which further comprises, a stop attached near the first end of the cable causing the first end of the cable to be captured within the chamber of the shaft, and wherein the second end of the cable extends from the distal end of the shaft and has an integral attachment loop;

a first weighted ball having an integral eyelet;

a connector removably linking the attachment loop on the second end of the cable to the eyelet of the weighted ball; and a grip mounted on the proximal end of the shaft.

10. The golf training device of claim 9 wherein the diameter of the stop is larger than the diameter of the distal end of the shaft and smaller than the diameter of the proximal end of the shaft.

11. The golf training device of claim 10 wherein the stop is a button stop.

12. The golf training device of claim 11 wherein the attachment loop is an eye nut integrally attached to the second end of the cable.

13. The golf training device of claim 12 further comprising a second weighted ball having an integral eyelet that can be interchanged with the first weighted ball by means of the connector, wherein the weights of the first and second weighted balls are different.

14. The golf training device of claim 13 wherein the connector is a quick link.

15. The golf training device of claim 13 wherein the connector is a carabiner.

16. A golf training device comprising:

a shaft having hollow chamber, a proximal end and a distal end, wherein the diameter of the proximal end of the shaft is larger than the diameter of the distal end of the shaft;

a flexible cable disposed within the hollow chamber of the shaft and having a first end and a second end, and which further comprises, a button stop attached near the first end of the cable causing the first end of the cable to be captured within the chamber of the shaft, and wherein the second end of the cable extends from the distal end of the shaft and has an integral attachment loop;

a plurality of weighted balls, each having an integral eyelet;

a connector removably linking the attachment loop on the second end of the cable to the eyelet of a selected on of the weighted balls; and a grip mounted on the proximal end of the shaft.

17. The golf training device of claim 16 wherein the connector is a quick link.

18. The golf training device of claim 16 wherein the connector is a carabiner.

* * * * *